US011008677B2

(12) United States Patent
Appleyard

(10) Patent No.: US 11,008,677 B2
(45) Date of Patent: May 18, 2021

(54) WOVEN SAILCLOTH

(71) Applicant: CONZEPTOR APS, Risskov (DK)

(72) Inventor: Colin Appleyard, Clonakilty (IE)

(73) Assignee: CONZEPTOR APS, Risskov (DK)

( * ) Notice: Subject to any disclaimer, the term of this patent is extended or adjusted under 35 U.S.C. 154(b) by 0 days.

(21) Appl. No.: 16/331,904

(22) PCT Filed: Sep. 6, 2017

(86) PCT No.: PCT/IB2017/055373
§ 371 (c)(1),
(2) Date: Mar. 8, 2019

(87) PCT Pub. No.: WO2018/051211
PCT Pub. Date: Mar. 22, 2018

(65) Prior Publication Data

US 2019/0194837 A1 Jun. 27, 2019

Related U.S. Application Data

(63) Continuation of application No. PCT/IB2017/055373, filed on Sep. 6, 2017.

(30) Foreign Application Priority Data

Sep. 13, 2016 (EP) ..... 16188619

(51) Int. Cl.
*B63H 9/06* (2020.01)
*D03D 1/00* (2006.01)
(Continued)

(52) U.S. Cl.
CPC ..... *D03D 1/00* (2013.01); *B63H 9/06* (2013.01); *D03D 11/02* (2013.01); *D03D 13/004* (2013.01);
(Continued)

(58) Field of Classification Search
CPC . B63H 9/06; D03D 1/00; D03D 11/02; D03D 15/00
See application file for complete search history.

(56) References Cited

U.S. PATENT DOCUMENTS 5,304,414 A 4/1994 Bainbridge et al.
5,403,641 A * 4/1995 Linville ..... B32B 5/26 428/113
(Continued)

FOREIGN PATENT DOCUMENTS

CN 101117746 A 2/2008
DE 7810405 U1 7/1978
(Continued)

OTHER PUBLICATIONS

International Search Report issued in PCT/IB2017/055373; dated Jan. 3, 2018.
(Continued)

*Primary Examiner* — Stephen P Avila
(74) *Attorney, Agent, or Firm* — Tatonetti IP

(57) ABSTRACT

A woven sailcloth has groups of load-bearing yarns which extend in straight lines through tunnels without being woven. The tunnels are bordered front and back by woven layers and at the sides by crossing-over yarns. Because the load-bearing yarns extend along the tunnels there is no crimp in their longitudinal direction. The load-bearing yarns may include components for resistance to displacement along the tunnels, such as resin adhesives or wrapped-around filament.

22 Claims, 2 Drawing Sheets

(51) Int. Cl.

| | |
|---|---|
| ***D03D 11/02*** | (2006.01) |
| ***D03D 13/00*** | (2006.01) |
| ***D03D 15/00*** | (2021.01) |

(52) U.S. Cl.
CPC ..... *D03D 15/00* (2013.01); *D10B 2321/0211* (2013.01); *D10B 2331/021* (2013.01); *D10B 2331/04* (2013.01); *D10B 2507/04* (2013.01)

(56) References Cited

U.S. PATENT DOCUMENTS

| | | | | |
|---|---|---|---|---|
| 5,789,327 | A * | 8/1998 | Rousseau | B32B 5/26 442/135 |
| 6,843,194 | B1 | 1/2005 | Baudet | |
| 7,886,777 | B2 | 2/2011 | Doyle | |
| 2003/0213421 | A1 * | 11/2003 | Baudet | B63H 9/067 114/102.29 |
| 2005/0287893 | A1 | 12/2005 | Lee et al. | |

FOREIGN PATENT DOCUMENTS

| | | | |
|---|---|---|---|
| EP | 0 013 432 | A1 | 7/1980 |
| EP | 0738339 | A1 | 10/1996 |
| FR | 2111991 | A1 | 6/1972 |
| WO | 95/18881 | A1 | 7/1995 |
| WO | 2010/068207 | A1 | 6/2010 |

OTHER PUBLICATIONS

The extended European Search Report issued by the European Patent Office dated Mar. 20, 2020, which corresponds to EP 17850369A-1016 and is related to U.S. Appl. No. 16/331,904.

* cited by examiner

WOVEN SAILCLOTH

FIELD OF THE INVENTION

The invention relates to sailcloth or cloth for other high-strength requirements such as indoor or outdoor architectural or functional items, tensioned or non-tensioned, such as but not limited to, weather protection items, temporary structures, and advertising items.

PRIOR ART DISCUSSION

In recent years sails made with lamination techniques have provided a means of reducing stretch in a sail. The method of production of laminated sailcloth, either produced in roll goods form or a membrane sail, allow the structure to exhibit low stretch results. This is due in part to the manufacturing process which allows the load bearing yarns to be laid in position with little or no deflection due to interaction with other yarns. The subsequent encapsulation process using film and glue ensures that the yarns remain in this state. Most membrane/laminated type sails use a vertical panel or load path orientation. Membrane laminates can allow more efficient sails to be made which in turn increases performance. Unfortunately they have several disadvantages such as high initial cost, fatigue and sail shape loss due to the film creasing.

The majority of woven sailcloth for use in headsails and mainsails use plain weave. Plain weave requires that the weft yarns pass under and over successive warp yarns and repeat the same pattern with alternate threads in the following row. For downwind sails a variation on plain weave is often used. At predetermined intervals a double or higher Denier yarn is incorporated in the warp and weft direction. This construction is normally called "rip stop" and is used to limit the amount of tearing due to a yarn failure during use.

Plain weave has the advantage of producing the most stable woven sail cloth, the tight weave of sail cloth helps to control the 45° bias elongation which is important for the life and efficiency of a sail. The disadvantage is that plain weave has a high amount of woven crimp especially in the warp direction. The weft, the direction across the width of the cloth and 90° to the warp, has less crimp. The sail is normally assembled with a horizontal panel orientation to take advantage of the lower crimp in the weft.

Crimp is defined as the waviness introduced into a yarn during the weaving process by the passing over and under other yarns positioned at right angles. It is an unavoidable result of the normal weaving process for sailcloth and is detrimental to the reduction of stretch in the resulting cloth. The amount of crimp can be quantified by removing a yarn from a cloth sample of known length, extending the yarn until the crimp is removed and measuring the extended length. The difference is then expressed as a percentage.

In a woven sailcloth as the load increases on a sail, the yarns are induced to become straight as the crimp is reduced. In a well constructed cloth with good quality yarn when the load is removed the yarns will recover. However repeated loading will eventually lead to reduced performance or sail failure. Also the 45° bias stability is compromised by the successive crimp extension and recovery.

The amount of crimp in a given yarn is determined by several factors such as yarn size, tensions during weaving, the frequency of yarn interlacing and number of yarns per unit of measurement. The amount of warp crimp in a woven sail cloth will normally be greater than that of the weft. Warp crimp is normally in the range of 5% to 20% and in the weft 0.5% to 3%. These norms can be exceeding depending on factors of yarn size, tension, yarn density etc. The high amount of woven crimp in the warp precludes many woven sail cloths from which vertically oriented panels can be assembled into an efficient sail.

When vertically orientated sail panels are loaded the warp yarns are extended as the crimp is removed. The result is that the sail panel length increases. The loads in different areas of a sail are of different magnitudes. It therefore follows that some panels will have high loads and others lower loads. When a panel is under load the panel length increases as the crimped warp yarn is extended. As the increase in panel length will be not be the same in all areas of the sail the shape will distort and be less efficient. When the load is removed the yarns will recover but high load areas will recover less than low load areas, which contributes to reduced service life.

EP0013432 (Cox, Plonentges & Schreus) describes a multilayer sailcloth with an option to add reinforcing yarns.

EP0738339 (Appleyard & Lecane) describes a method to incorporate higher modulus yarns in the weft direction in a woven sailcloth by modifying the yarns used before weaving.

WO 2010/068207 (Cronburg) describes a method whereby the yarn is heated above ambient prior to weaving, providing crimp transfer from the warp yarns to the weft yarns.

U.S. Pat. No. 7,886,777 (Doyle) describes a method to reduce woven crimp in the warp yarns by transferring warp crimp to textured fill yarns.

The invention is directed towards providing a woven cloth which is less susceptible to distortion under load conditions and subsequent relaxation, and/or which has reinforcing yarns which have an improved load-bearing capability, and/or which has less crimp in the warp direction than prior woven cloths.

SUMMARY OF THE INVENTION

A cloth comprises at least two woven layers including a first woven layer and a second woven layer which are interconnected and form parallel tunnels, and load-bearing yarns extending through the tunnels, in which there is at least one load-bearing yarn per tunnel for a plurality of said tunnels.

Preferably, there is a plurality of load-bearing yarns in each tunnel. The first woven layer may have a yarn which crosses over and is woven in the second woven layer at intervals, and this yarn preferably crosses over to form sides of said tunnels.

The second woven layer may have a yarn which crosses over and is woven in the first woven layer at intervals, and this yarn preferably crosses over to form sides of said tunnels.

The first and second woven layers are preferably interconnected by stitching, preferably by a yarn in one or both of adjoining layers between said tunnels.

Preferably, there are at least two intermediate stitches formed between each tunnel.

Preferably, tenacity of the load bearing yarns is greater than that of the parallel yarns in the first and second layers, and preferably strength characteristic tenacity of the load-bearing yarns are greater than 6 grams per Denier, and more preferably greater than 8.5 grams per Denier.

There may be greater than 50 tunnels per metre, and preferably greater than 80 tunnels per metre in a direction across the tunnels.

There may be at least five load-bearing yarns in at least some tunnels. Preferably, the load-bearing yarns are in a multi-layer structure with a plurality of layers between the first and second layers.

Preferably, the cloth further comprises a component to assist resistance to displacement of load-bearing yarns along the tunnels. Said components may include an adhesive compound in said tunnels. Preferably, at least some of the load-bearing yarns are exposed at parts of their length and said anti-slippage component engages the load-bearing yarns at said exposed locations.

At least some load-bearing yarns may each include one or more filament wrapped around the load-bearing yarn.

We also describe a boat sail comprising a cloth of any embodiment.

We also describe a method of manufacturing a cloth of any embodiment, the method comprising weaving the yarns according to one or more of the following parameters to achieve desired cloth strength characteristics:

number of tunnels per unit length,
number of load-bearing yarns per tunnel,
number of yarns per tunnel,
yarn strength per unit length in said first and second layers, and
tenacity of the load bearing yarns.

The load-bearing yarns may be pre-treated for enhanced resistance to displacement, and said pre-treatment may include heat or chemical-induced shrinking, and/or may include wrapping a filament around each load-bearing yarn.

ADDITIONAL STATEMENTS

According to the invention, there is provided a cloth comprising at least two woven layers including a first woven layer and a second woven layer which are interconnected and form parallel tunnels, and load-bearing yarns extending through the tunnels, in which there is at least one load-bearing yarn per tunnel for a plurality of said tunnels.

In one embodiment, there is a plurality of load-bearing yarns in each tunnel.

In one embodiment, the first woven layer has weft yarn which crosses over and is woven in an adjoining second woven layer at intervals. Preferably, said weft yarn crosses over to form sides of said tunnels. Preferably, the second woven layer has weft yarn which crosses and is woven in the first woven layer at intervals.

In one embodiment, said weft yarn crosses over to form sides of said tunnels. In one embodiment, said woven layers are interconnected by stitching. In one embodiment, said stitching is by a weft yarn in one or both of adjoining layers, between said tunnels. Preferably, there are at least two intermediate stitches formed between each tunnel.

In one embodiment, tenacity of the load bearing yarns is greater than that of the warp yarns. In one embodiment, strength characteristics of the load-bearing yarns are greater than 6 grams per Denier. Preferably, the load bearing yarns have greater than 8.5 grams per Denier.

In one embodiment, there are greater than 50 tunnels per metre, and preferably greater than 80 tunnels per metre.

In another aspect, the invention provides a boat sail comprising a cloth of any preceding claim as a sailcloth.

In a further aspect, the invention provides a method of manufacturing a cloth of any embodiment, the method comprising weaving the yarns according to one or more of the following parameters to achieve desired cloth strength characteristics:

number of tunnels per unit length,
number of load-bearing yarns per tunnel,
Denier and yarn type of the load-bearing yarn in each tunnel,
the number of yarns and yarn strength per unit length in said first and second
layers, and
tenacity of the load bearing yarns.

DETAILED DESCRIPTION OF THE INVENTION

Brief Description of the Drawings

The invention will be more clearly understood from the following description of some embodiments thereof, given by way of example only with reference to the accompanying drawings in which.

DESCRIPTION OF THE EMBODIMENTS

We describe a cloth comprising at least two woven layers including a first woven layer and a second woven layer which are interconnected and form parallel tunnels which are preferably in the warp direction. Load-bearing or "reinforcing" yarns extend through at least some of the tunnels. At least some tunnels each have more than one load-bearing yarn.

The cloth may include means to retain or hold the load bearing yarns in position to prevent or minimise slippage displacement.

A first woven layer has weft yarn which crosses over and is woven in an adjoining second woven layer at intervals, in which weft yarn crosses over to form upper and lower sides of the tunnels. Also, the second woven layer has weft yarn which crosses and is woven in the first woven layer at intervals. In other examples it is the warp yarn which crosses over, terms "weft" and "warp" meaning being defined as the yarns which extend across and along respectively.

The woven layers are interconnected by stitching laterally between the tunnels by a yarn in one or both of the adjoining layers. Preferably, there are at least two intermediate stitches formed between each tunnel.

Tenacity of the load bearing yarns is greater than that of the parallel yarns, in one example warp yarns, and in one case the tenacity of the load-bearing yarns are greater than 6 grams per Denier. Preferably, the load bearing yarns have greater tenacity than 8.5 grams per Denier.

Figure 1:
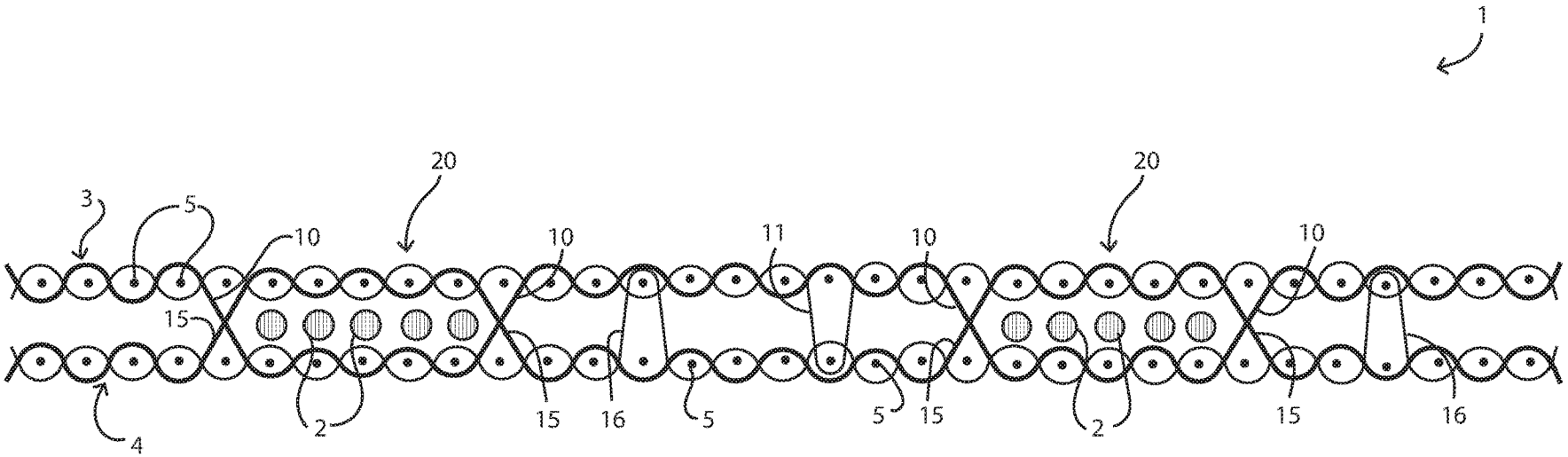
FIG. 1 is a diagrammatic cross-sectional view across the warp of portion of a sailcloth of the invention.

In more detail, referring to FIG. 1 a sailcloth 1 comprises woven layers 3 and 4 between which are load-bearing yarns 2. The load-bearing yarns 2 are in groups of five large-diameter yarns, the groups being equally spaced at intervals across the weft direction. In this case the direction across the page is defined as the weft direction and the direction out of the plane of the page is defined as the warp direction. The load-bearing yarns 2 are independent of the weaving of the various other yarns—being trained without bends in the load-bearing direction (out of the plane of the page).

Each group of five load-bearing yarns may be regarded as being in a "tunnel" 20 between the woven layers 3 and 4 at the front and rear, and sides being formed in the weft direction by crossing-over weft yarns.

The top layer 3 comprises parallel warp yarns 5 and two sets of opposed inter-woven weft yarns 10 and 11. Although not shown in the drawing, as is well known in the field the warp yarns 5 also cross over the weft yarns 10 and 11 out of the plane of the page. For clarity, the weft yarn 10 is shown thicker than the weft yarn 11, however this is merely to illustrate them so that they can be distinguished. They are preferably the same thickness.

Equally, the layer 4 has parallel warp yarns 5 and inter-woven weft yarns 15 and 16.

The weft yarns 10 and 15 also cross over to the other layer to encompass the load-bearing yarns 2. The weft yarns 11 and 16 also cross over to the opposite layer, but only for intermediate stitching at periodic intervals.

Yarn Sizes and Materials

The yarn compositions (materials) are in this specific embodiment:

- load-bearing yarns 2: 2500 Denier polyester tenacity of 8.5 grams per Denier,
- warp yarns 5: 150 Denier polyester tenacity of 7 grams per Denier,
- weft yarn 10: 250 Denier polyester tenacity of 7 grams per Denier,
- weft yarn 11: 250 Denier polyester tenacity of 7 grams per Denier,
- weft yarn 15: 250 Denier polyester tenacity of 7 grams per Denier, and
- weft yarn 16: 250 Denier polyester tenacity of 7 grams per Denier, In other embodiments the yarn compositions (materials) may include but are not confined to UHMWPE, (Ultra High Molecular Weight Polyethene) polyolefin, aramid, LCP (Liquid Crystal Polymer). These are often marketed under registered trades such Vectran®, Kevlar®, Dyneema®, Spectra®.

The strength characteristics (tenacity) of the load-bearing yarns 2 are greater than 6 grams per Denier.

The sum total of the Denier of all load bearing yarns contained within a single tunnel may be calculated and expressed as total denier per centimetre (Den/cm). The same calculation should be done for the combined ground and tunnel warp yarns. The results should then be compared to ensure the Den/cm of the load bearing yarns is greater than the Den/cm of the ground and tunnel yarns. The magnitude of the difference can be adjusted by varying the following items: number of tunnels per cm, number, denier and yarn type in each tunnel, the number of yarns per cm. and denier. The preferred tenacity of the load bearing yarns is greater than 8.5 grams per denier. If high modulus yarns are used for the load bearing yarns the Den/cm may be reduced.

The cover factor (CF) for ground and tunnel warp yarns, can be calculated by the formula:

$$(\text{yarns per centimetre}/10)\times\text{square root}(\text{denier}/9).$$

The result for ground and tunnel warp yarns should be added together to give a total warp CF. The weft CF is calculated by using the same formula. The weft CF may be up to 10% lower than the CF of the combined ground and tunnel yarns.

The range of tunnels per metre across the width (the weft direction) is preferably in the range of 50 to 175, and more preferably 80 to 125 per metre. However the actual number of tunnels per metre may be varied outside of this range according to the requirements of a particular end use, for example sail type or position of use in a sail. Different sections of the woven cloth may have different tunnel densities.

There are several ways to indicate the yarn strength. a) Breaking load—directly related to the Denier, the higher the Denier, (increased cross sectional area) the greater the load required to break the yarn. However the result is only valid for that particular Denier. b) Elongation at break is not a direct indicator of strength but a yarn with high extension might take 20 kgs to break but if it extends more than 20% before breaking it is not suitable, again this only relates to a particular Denier. c) Tenacity uses the Denier in the calculation by using the formula load at break/Denier. The result provides a relationship between yarns of different Denier and across all yarn types as it allows for the different cross section area. The results provide a simple basis for comparison. For example 1000 Denier break load 8 kg has a tenacity of 8 grams per Denier. If one needs to match a higher Denier yarn of say 1400 and a break load of say 7 kgs the tenacity is 5 gm/den so is not suitable. It is common practice to segregate yarns into divisions of tenacity. NT=Normal Tenacity or MT=Medium Tenacity, HT=High Tenacity. Unfortunately there is no consensus as to the boundaries of each type by chemical composition and tenacity. The most common is NT (MT less than 7 grams per Denier, and HT is greater than 6 grams per Denier).

The load bearing yarns 2 are included in the cloth in a predetermined number and sequence according to the intended application.

The setup and programming of the weaving machine is such that the sequence of interlacing and interchanging of the yarn sets form tubes or tunnels in the cloth. Each "tunnel" includes a group of load-bearing yarns 2. The warp yarns 5 adjacent the load-bearing yarns are referred to as "tunnel warp yarns" and those in-between are referred to as "ground warp yarns". Each tunnel has an upper surface and lower surface. The extremities of each tunnel are connected to the body of the cloth which avoids excessive flexing between tunnels.

The preferred sequence of ground and tunnel weave interlacing is plain weave and double plain, which is well known to those experienced in the art.

The ground and tunnel warp yarns 5 can be of any type, size or tenacity. Preference is polyester or nylon, size range from 20 Denier to 500 Denier or the equivalent in other yarn numbering systems and a tenacity of greater than 7 grams per Denier.

The load bearing yarn used can be of any type, size or tenacity and is determined by reference to the application. The preferred range of a single load-bearing yarn is in the range from 200 to 6000 Denier or the equivalent in other yarn numbering systems. Preference is for the tenacity of the load bearing yarns to be greater than the ground and tunnel warp yarns.

In the direction of the load bearing yarns the ground and tunnel yarns have a similar amount of thermal or chemical shrinkage.

In the direction 90° to the load bearing yarns the parallel yarns have similar tenacities to those of the yarns in the ground and tunnel yarns and preferably have a higher amount of thermal or chemical shrinkage.

The weaving machine is programmed so that the load bearing yarns are totally encased within the tunnels. They are not woven into the structure and do not have any woven crimp.

The load bearing yarns encased within each tunnel can vary in number, size and type within the same tunnel if desired.

After weaving is complete the cloth is processed in such a manner to allow the yarns with a higher amount of potential shrinkage to fully shrink and tighten upon the load bearing yarns.

Figure 2:
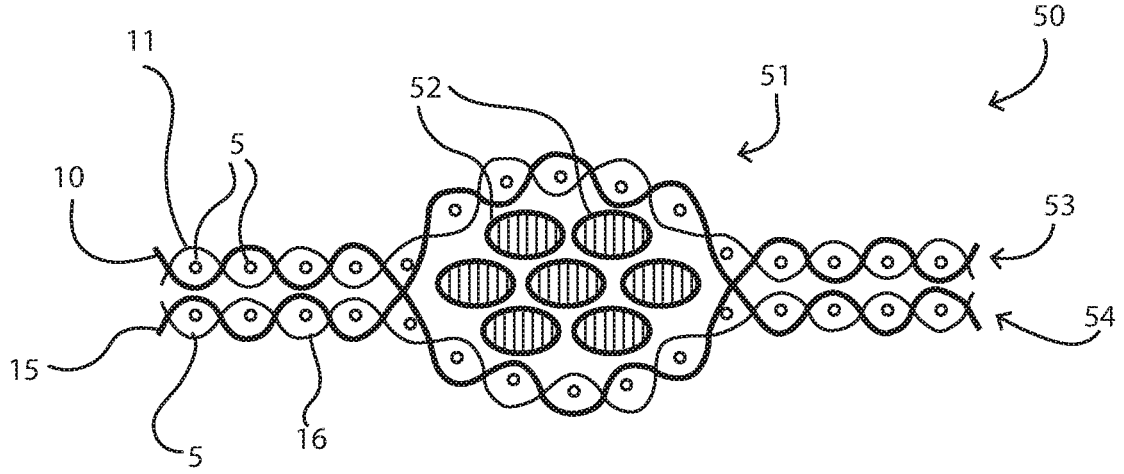
FIG. 2 is a cross-sectional view in the weft direction of part of an alternative woven cloth.

The size of the tunnels is determined by the final design requirement, the size and number of the load bearing yarns. For example, as shown in FIG. 2 a woven cloth 50 has yarns 5, 10, 11, 15, and 16 as for the cloth 1 of FIG. 1. However, in this case there are tunnels 51 formed between layers 53 and 54, each tunnel having seven load-bearing yarns 52. Within each tunnel the load-bearing yarns are arranged in a multi-layer structure namely a bottom layer of two yarns, a middle layer of three yarns, and a top layer of two yarns.

Further stabilisation or treatment such as coating with resin and/or with a water repellent composition may be performed. In some embodiments additional yarns or other components may be included in the tunnels together with the load bearing yarns for purpose of positional control to prevent slippage displacement. These components may include hot melt yarns, either 100% type or bi-component type, these can be incorporated as individual yarns or pre-wrapped around the load bearing yarns before weaving. The load bearing yarns can be treated before weaving with single or multi-part resin or adhesive and activated after weaving. After weaving, processing with resin, activators or other coating materials which penetrate the tunnel may be performed. Alternatively or additionally, the load bearing yarns may be exposed at intervals on either or both sides of the cloth for contact with an anti-slippage component such as a bonding resin. The amount of exposure and anti-slippage component is determined by the final performance requirements. In one embodiment, consecutive machine revolutions provide such exposures by the programming of the warp lifting sequence and moving the woven cloth forward at a constant preset speed according to the desired length of exposure.

During manufacture, the weaving machine may have a fixed speed, inserting one weft every machine revolution. The space occupied by one weft depends on the denier and the setting on the machine to move the cloth forward prior to the next weft insertion. The thicker the weft the more the machine will advance the cloth before the next insertion.

It will be appreciated that the present invention provides an improved woven cloth which allows load bearing yarns to be incorporated into a woven structure. The incorporation is without any interlacing with other yarns in the structure, thereby ensuring the load bearing yarns have no woven crimp.

Also, it eliminates the cross-over between layers, which we believe reduces chances of premature fatigue.

There is no crimp in the load bearing yarns in the warp direction. Also, the load bearing yarns have no woven crimp and are totally encased in the body of the cloth, thereby protecting them from abrasion.

The tight weaving of traditional woven sailcloth is utilised to full advantage and thereby provides stability in the 45° direction, especially as there is no crimp transfer to the weft.

The securing and positioning of the load bearing yarns may be enhanced by weaving techniques and post weaving operations. These include shrinking the yarns by heat or chemicals, activation of pre-weaving processes applied to yarns, such as hot melt yarns, and/or use of adhesives of one or multi part system types.

For example, it is possible to fix the position of at least some load-bearing yarns by a fine mono-filament stitching weft yarn.

The invention is not limited to the embodiments described but may be varied in construction and detail. For example, the cloth of the invention may be for applications other than sailing.

The invention claimed is:

1. A sailcloth comprising:

a first woven layer, a second woven layer, wherein said first and second woven layers are interconnected and form parallel tunnels in the warp direction, and load-bearing yarns, each extending through and parallel to a tunnel, in which there is at least one load-bearing yarn per tunnel for a plurality of said tunnels.

2. The sailcloth as claimed in claim 1, wherein there is a plurality of load-bearing yarns in each tunnel.

3. The sailcloth as claimed in claim 1, wherein the first woven layer has yarn which crosses over and is woven in the adjoining second woven layer at intervals.

4. The sailcloth as claimed in claim 1, wherein the first woven layer has yarn which crosses over and is woven in the adjoining second woven layer at intervals; and wherein said yarn crosses over to form sides of said tunnels.

5. The sailcloth as claimed in claim 1, wherein the first woven layer has yarn which crosses over and is woven in the adjoining second woven layer at intervals; and wherein the second woven layer has yarn which crosses over and is woven in the first woven layer at intervals.

6. The sailcloth as claimed in claim 1, wherein the first woven layer has yarn which crosses over and is woven in the adjoining second woven layer at intervals; and wherein said yarn crosses over to form sides of said tunnels; and wherein said yarn crosses over to form sides of said tunnels.

7. The sailcloth as claimed in claim 1, wherein said first and second woven layers are interconnected by stitching.

8. The sailcloth as claimed in claim 1, wherein said first and second woven layers are interconnected by stitching; and wherein said stitching is by a yarn in one or both of adjoining layers between said tunnels.

9. The sailcloth as claimed in claim 1, wherein said first and second woven layers are interconnected by stitching; and wherein said stitching is by a yarn in one or both of adjoining layers between said tunnels; and wherein there are at least two intermediate stitches formed between each tunnel.

10. The sailcloth as claimed in claim 1, wherein tenacity of the load bearing yarns is greater than that of the parallel yarns in the first and second layers.

11. The sailcloth as claimed in claim 1, wherein strength characteristic tenacity of the load-bearing yarns are greater than 6 grams per Denier.

12. The sailcloth as claimed in claim 1, wherein strength characteristic tenacity of the load-bearing yarns are greater than 6 grams per Denier; and wherein the tenacity is greater than 8.5 grams per Denier.

13. The sailcloth as claimed in claim 1, wherein there are greater than 50 tunnels per metre, and preferably greater than 80 tunnels per metre in a direction across the tunnels.

14. The sailcloth as claimed in claim 1, wherein there are at least five load-bearing yarns in at least some tunnels; and wherein the load-bearing yarns are in a multi-layer structure with a plurality of layers between the first and second layers.

15. The sailcloth as claimed in claim 1, wherein the sailcloth further comprises a component to assist resistance to displacement of load-bearing yarns along the tunnels; and wherein said components include an adhesive compound in said tunnels.

16. The sailcloth as claimed in claim 1, wherein the sailcloth further comprises a component to assist resistance to displacement of load-bearing yarns along the tunnels; and wherein said components include an adhesive compound in said tunnels; and wherein at least some of the load-bearing yarns are exposed at parts of their length and said anti-slippage component engages the load-bearing yarns at said exposed locations.

17. The sailcloth as claimed in claim 1, wherein at least some load-bearing yarns each include one or more filament wrapped around the load-bearing yarn.

18. A method of manufacturing a sailcloth comprising:

a first woven layer, a second woven layer, in which said first and second woven layers are interconnected to form parallel tunnels, and load-bearing yarns extending through the tunnels, the method comprising weaving the yarns according to one or more of the following parameters to achieve desired cloth strength characteristics:

number of tunnels per unit length, number of load-bearing yarns per tunnel, number of yarns per tunnel, yarn strength per unit length in said first and second layers, and tenacity of the load bearing yarns.

19. The method as claimed in claim 18, wherein the load-bearing yarns are pre-treated for enhanced resistance to displacement.

20. The method as claimed in claim 18, wherein said pre-treatment includes heat or chemical-induced shrinking.

21. The method as claimed in claim 18, wherein said pre-treatment includes wrapping a filament around each load-bearing yarn.

22. A boat sail comprising a sailcloth of claim 1.

* * * * *